United States Patent [19]

Grollman

[11] Patent Number: 4,899,929

[45] Date of Patent: Feb. 13, 1990

[54] SELF-ERECTING CONTAINER WITH REMOVABLE SECTION

[75] Inventor: Jack D. Grollman, Merion, Pa.

[73] Assignee: Triangle Container Corporation, Philadelphia, Pa.

[21] Appl. No.: 348,267

[22] Filed: May 24, 1989

[51] Int. Cl.[4] ..... B65D 5/36

[52] U.S. Cl. ..... 229/122.1; 221/302; 221/305; 229/117

[58] Field of Search ..... 229/122, 122.1, 41 R, 229/41 B, 117; 221/302, 305, 306; 312/42, 49, 259, 260; 206/620

[56] References Cited

U.S. PATENT DOCUMENTS

| | | | |
|---|---|---|---|
| 3,207,380 | 9/1965 | Hennessey | 229/122.1 |
| 3,494,536 | 2/1970 | Henry | 229/39 |
| 3,517,875 | 6/1970 | Wakefield | 229/39 |
| 3,568,883 | 3/1971 | Reynolds | 221/305 |
| 3,731,873 | 5/1973 | Brangle, Jr. | 229/41 R |
| 3,889,867 | 6/1975 | Berg | 229/28 |
| 3,927,824 | 12/1975 | Razziano | 229/41 B |
| 4,222,598 | 9/1980 | Ullger | 294/1 |
| 4,550,834 | 11/1985 | Fletcher et al. | 206/611 |
| 4,739,224 | 4/1988 | Zimmermann | 229/122 |
| 4,805,765 | 2/1989 | Barrett et al. | 206/45 |

FOREIGN PATENT DOCUMENTS

| | | | |
|---|---|---|---|
| 220174 | 8/1924 | United Kingdom | 229/41 B |
| 1548711 | 7/1979 | United Kingdom | 229/41 R |

*Primary Examiner*—Gary Elkins

*Attorney, Agent, or Firm*—Steele, Gould & Fried

[57] ABSTRACT

A self-erecting container 20 has a removable section 32 adjacent the engaging panels of a self-erecting end structure, and a permanent web which supports the self-erecting structure notwithstanding separation of the removable panel. A front side wall panel 24 has a removable section 32 at an end of the container adjacent the self-erecting structure 42, 44, 54, 56. A flap panel 44 is attached at least initially to the removable section 32. An end panel 56 adjacent the flat panel 44 has a back-folded tab 62 fixed to the flap panel 44 by a permanently attached web 60, maintaining the structural integrity of the self-erecting container bottom when removable section 32 is separated from front side wall panel 24.

20 Claims, 3 Drawing Sheets

FIG. 7
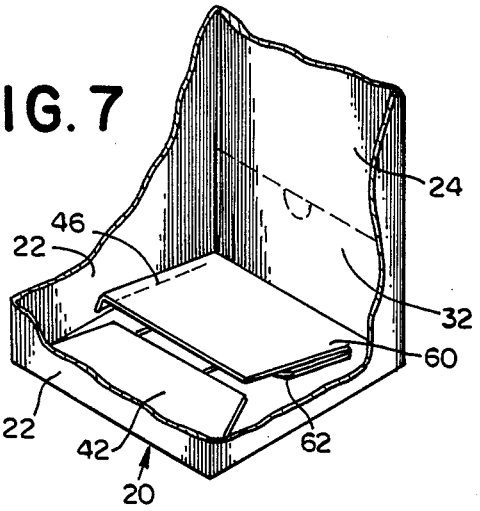
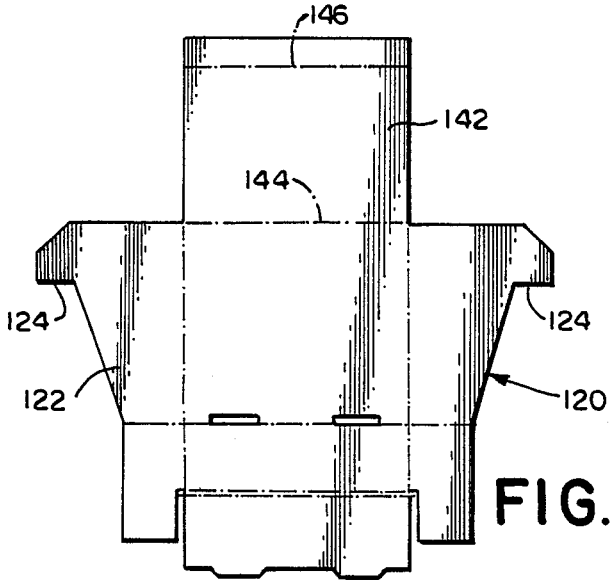
FIG. 8
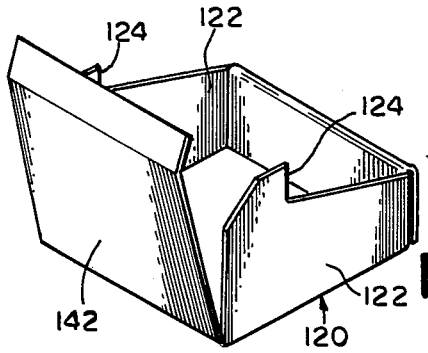
FIG. 9

SELF-ERECTING CONTAINER WITH REMOVABLE SECTION

BACKGROUND OF THE INVENTION

1. Field of the Invention

This invention relates to the field of collapsible containers with self-erecting panels and containers with removable panels, and in particular to a collapsible self-erecting container wherein a removable panel is contiguous with one or more of the self-erecting panels.

2. Prior Art

Self-erecting containers and containers with removable panels for access to container contents are both well known concepts in the art. U.S. Pat. No. 4,805,765-Barrett discloses a dispensing package with an outer container having a tray disposed inside the container, on the bottom. A removable section defined by perforations at the lower frontal portion of the container allows the tray to be pulled forwardly through an opening in the container, giving access to the contents of the container resting in the tray member. An inclined panel foldably attached to the bottom of the tray rests against the inner back wall of the container when the tray is fully within the container, and defines an inclined plane leading the contents of the container into the tray when the tray is advanced through the opening.

A commercial embodiment of the container and tray of Barrett is in use, being a dispensing container used, for example, in marketing of countertop displays of York Peppermint Patties. In addition to the tray, the commercial embodiment uses a collapsible construction wherein a self-erecting structure is employed on the side panel of the container opposite from the removable section through which the tray can be advanced. In the same manner as disclosed in the Barrett patent, the tray has a rear panel which is quite long, extending clear to the top of the container when the tray is in place within the container. As a result, the structures defining the self-erecting panel are covered by the inclined tray panel and there is no possibility (so long as the tray is fully within the container) that any of the contents will become caught on the self-erecting panel structures. However, when the tray is advanced, the top edge of the rear panel moves downwardly from the top of the container and there is a possibility that container contents may become fouled on the self-erecting structures.

It is normally necessary in a self-erecting container to have an ultimate closure for the container placed on a side opposite from the self-erecting portions such that the container can be collapsed, erected, filled, then closed. Accordingly, in the Peppermint Patties type package, the container is closed by a flap extension of the front side wall panel, which is glued to the outside of an underlying side wall panel. Therefore, although the tray is on the bottom, these packages must be loaded from the front. Production personnel erect the container, fold the tray into shape and load the contents through the shallower dimension of the container defined from front to back. Contents are accordingly sometimes dropped and must be discarded; the tray front is in the way during loading; and the arrangement is not suitable for fully automated operation.

According to the present invention, the self-erecting portion in a container of this type is provided on the bottom rather than the rear. The final closure is disposed on the top by means of inwardly-foldable flaps. Accordingly, in any position of the container and tray, the tray protects the contents from becoming fouled on the self-erecting portions. The container is filled from the top into its deepest dimension, being assembled ahead of time from an integral sheet. The attachment between side panels at the ends of the sheet, as necessary to complete the perimeter of the container, is accomplished ahead of time, and only the top flaps need be closed. The top flaps can be arranged upwardly or caused to flare to define a funnel into the container, whereby loss of container contents during loading is minimized.

Moving the self-erecting structures of a container from panel to panel, e.g., from the back to the bottom, may seem routine at first, until one realizes that when the removable section of the side panel is attached to one of the panels which define the self-erecting structure, removal of the panel defeats the self-erecting nature of the structure. Accordingly, it has not been possible to achieve the benefits of the invention, namely top loading, protection of the contents from fouling the self-erecting structures and the like in a pull tray container. Therefore, extra packaging material, and extra production personnel time has been expended unnecessarily.

U.S. Pat. No. 4,739,922-Zimmermann discloses a container having a dispensing opening in the lower portion of the front wall, through which articles can be withdrawn. This package includes a self-erecting bottom structure. However, according to Zimmermann, the opening through which contents can be withdrawn is spaced above the self-erecting bottom by a distance approximately equal to the dimensions of one of the articles of contents. This patent solves the problem by displacing the access opening from the self-erecting structures.

Examples of other self-erecting containers are disclosed, for example, in U.S. Pat. Nos. 3,517,875-Wakefield; 3,494,536-Henry; 4,222,598-Ullger; and, 4,550,834-Fletcher et al. In the Fletcher disclosure, a tear out section is provided, encompassing substantially a complete side panel. Insofar as the tear out section approaches the self-erecting panels at an end of the container, the Fletcher package solves the problem by reducing the dimensions of the tear out portion at the corners of the panel adjacent the self-erecting structure. In other words, the tear out panel can be removed completely except adjacent the self-erecting structures, where the tear out panel is reduced in size to less than the width of the side wall panel upon which the tear out panel is disposed. Removing the tear out panel leaves in place portions of the side wall attached to the self erecting panels.

The Fletcher carton also has a tuck-in flap, arranged on an opposite end from the self-erecting structures. Unlike the situation adjacent the self-erecting structures, the tear out portion of the Fletcher side panel extends clear to the edge of the tuck-in flap, whereby removing the tear out portion would normally disengage the tuck-in flap completely, i.e., on all four sides. However, Fletcher has included an in-folding bellows fold connecting the tuck-in flap and the adjacent in-folding flaps on the end opposite from the self-erecting structures. While this solves the problem of possible loss of the tuck-in flap, the drawback is that the tuck-in flap cannot be completely opened because its sides adjacent the normal folding edge are permanently affixed to the adjacent flaps along a distance from the folding edge.

There has been a need to resolve the conflict between removable sections and self-erecting panels in a way that does not carry adverse consequences for erecting the container, for loading or for closing it. The present invention resolves the conflict by arranging an in-fold flap over the self-erecting container bottom. The flap is permanently affixed to an adjacent fold-in panel by a web attaching to an in-folding tab on the self-erecting panel structure. Accordingly, the container can be substantially completely constructed but for the top closure flaps, stored in a collapsed condition and simply erected, provided with a tray and loaded in a minimum of operations. The invention therefore facilitates packaging of items, including packaging of items using automated loading and handling equipment. When the tear out panel is opened, the web retains the integrity of the self-erecting panel structures.

SUMMARY OF THE INVENTION

It is an object of the invention to provide a means by which a removable panel can be situated directly adjacent the panels of a self-erecting structure, without detracting from operation of either the removable panel or the self-erecting structure.

It is a further object of the invention to provide a dispensing container having a bottom tray for access to container contents, using a minimum of material and with maximum loading efficiency.

It is another object of the invention to provide a durable and efficient container for dispensing small articles.

These and other objects are accomplished by a self-erecting container with a removable section adjacent the engaging panels of a self-erecting structure, and a permanent web which supports the self-erecting structure at least on one side notwithstanding separation of the removable panel. A front side wall panel has a removable section at an end of the container adjacent the self-erecting structure. A flap panel is attached at least initially to the removable section. An end panel adjacent the flat panel has a back-folded tab fixed to the flap panel by a permanently attached web, maintaining the structural integrity of the self-erecting container bottom when the removable section is separated from front side wall panel.

BRIEF DESCRIPTION OF THE DRAWINGS

There are shown in the drawings the embodiments that are presently preferred. It should be understood, however, that the invention is not limited to the precise arrangements and instrumentalities shown in the drawings, wherein:

FIG. 7 is a cut away perspective view showing the nearly-erected container from the inside.

FIG. 8 is a plan view of a blank for forming the tray member, fold lines being shown in dash-dot lines.

FIG. 9 is a perspective view of the tray member as folded into operative condition.

DETAILED DESCRIPTION OF THE PREFERRED EMBODIMENTS

Figure 1:
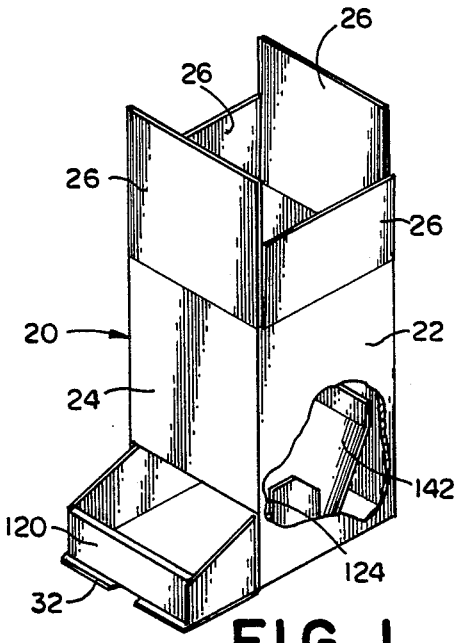
FIG. 1 is a partially cut away perspective view of a container according to the invention, with the removable section separated and the dispensing tray pulled forward.

As shown in FIG. 1, the container 20 has a plurality of side wall panels 22 defining an inner volume. One of the panels is a front side wall panel 24. The side wall panels are preferably vertical when the container is deployed for dispensing; however it will be appreciated that the designations "vertical", "top", "bottom", etc., are for convenience in describing the device and the container can also be used when oriented otherwise. Flap closure panels 26 are provided to seal the top after the container is loaded. At the bottom of the container a tray member 120 is disposed and when pulled forwardly as shown in FIG. 1, the tray member 120 allows access to the contents of the container. The contents may be discrete articles which are brought forward on the tray and/or spilled downwardly into the tray from the inner volume of the container 20.

A removable or separable panel 32 is provided in the lower portion of front panel 24, being normally connected to panel 24 by a perforation 34, extending at least around three sides of the removable section 32, namely the top and both lateral sides where removable panel 32 abuts side panels 22. Removable panel 32 can be shaped in various configurations, the illustrated example being a rectangular opening with a perforated section for opening a finger hole to engage panel 32. Other possibilities include, for example, an arched edge along the top of removable section 32, an opening which is larger on one side than the other, etc. In each case the removable section or panel 32 extends across the width of the front panel adjacent the bottom. The removable panel may be completely removable, or merely separable along its top and lateral sides.

Figure 2:
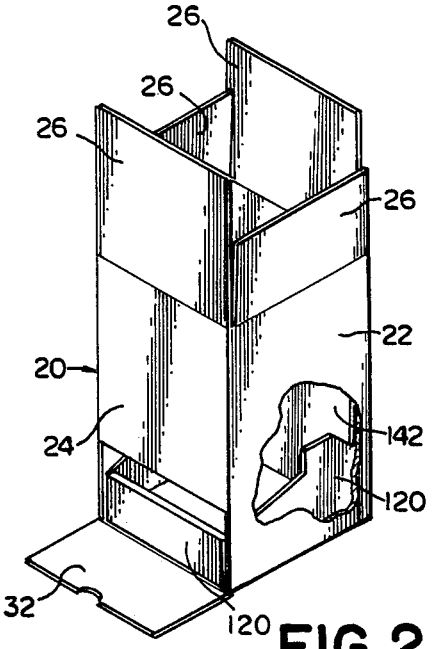
FIG. 2 is a partially cut away perspective view with the dispensing tray in the storage position and the removable section folded open.

When panel 32 is separated from sidewall 24, tray member 120 can be pulled forward by an amount defined by the structure of the side walls 122 of tray member 120. The side walls of the tray member have raised stop sections 124 on one or both sides. These sections 124 abut against the inside of front panel 24 when the tray is pulled forwardly to its full extension. In so doing, the foldable back panel 142 of tray member 120 moves from a vertical position as shown in FIG. 2 to an inclined position as shown in FIG. 1, the contents of the container remaining above inclined panel 142, which operates as an inclined plane to allow the contents to slide toward the tray member 120.

The container 20 is preferably formed from an integral sheet with the perforations and folds defined therein. The material can be, for example, corrugated kraft paper (cardboard) or the like. The perforations can be formed as spaced cuts or holes, and the fold lines can be defined for example by perforations to weaken the material along a fold, by scoring the corrugated craft paper through one of its facing sheets, or simply by compressing the material along the fold line. In the drawings, the perforations between removable section 32 and front panel 24, as well as the adjacent side panels 22, are shown by a solid lines. Fold lines are shown in dash-dot lines.

Figure 3:
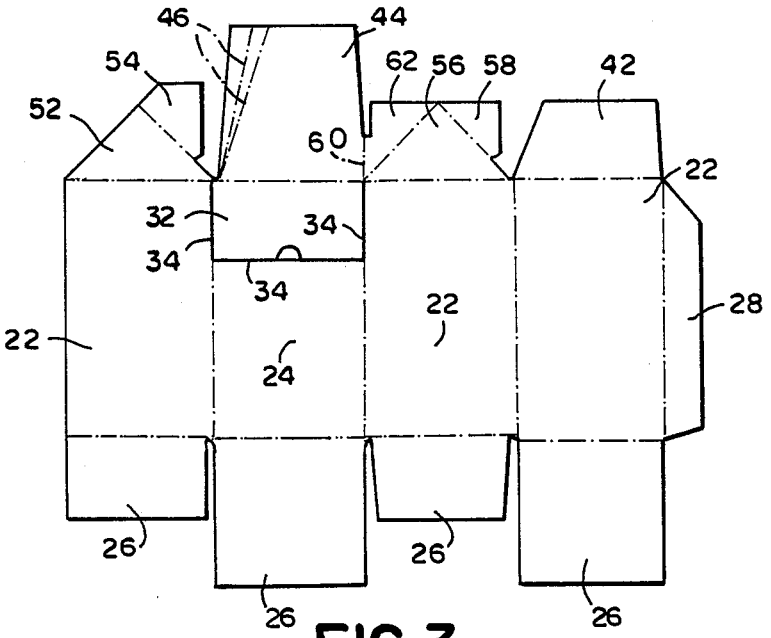
FIG. 3 is a plan view of a container according to the invention, fold lines being indicated as dash-dot lines.
Figure 4:
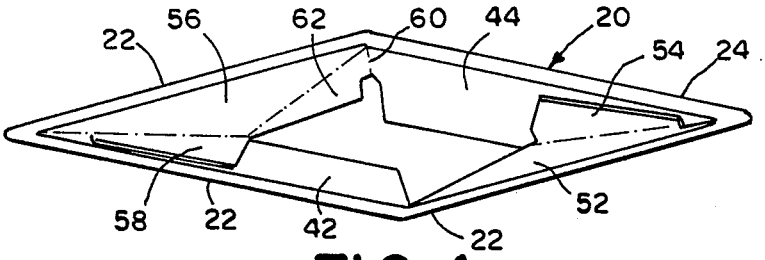
FIG. 4 is an end elevation view of the container in a partially collapsed condition.
Figure 5:
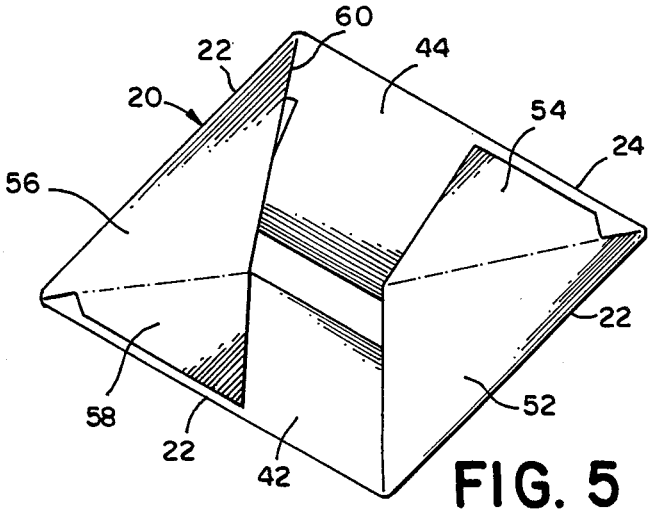
FIG. 5 is an end elevation view thereof, the container shown nearly erected.
Figure 6:
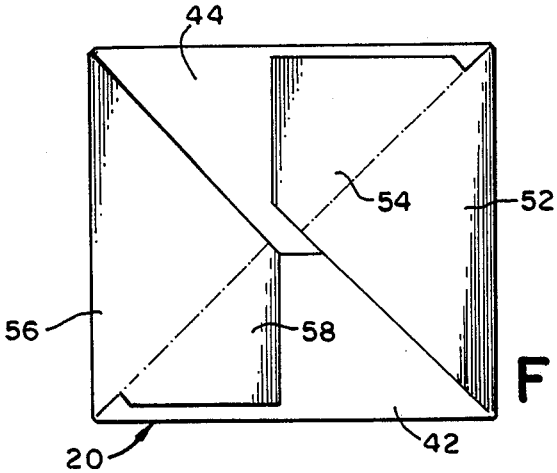
FIG. 6 is an end elevation view, with the container shown fully erect.

As a first step in production, the blank is cut out, perforated and/or scored as shown in FIG. 3. Glue tabs 54, 58 of the self-erecting bottom portion, and also the glue tab 28, which adhesively affixes adjacent side wall panels 22 at one corner of the container, are glued and the container is stored in a collapsed condition, i.e., folded flat. When the glue cures, forcing open the sidewalls to open the inner volume has the effect of pulling the self-erecting panels 42, 44, 52, 56 into engagement, resulting in a stable rectilinear container structure. The specifics of self-erecting containers in general are known in the art, including the references mentioned hereinabove, which are hereby incorporated. Briefly, glue tabs 54, 58 are folded backwardly on their respective end panels 52, 56 and then glued to the adjacent flap panels 44, 42. In particular, glue tab 54 is folded back against end panel 52, with the glue or other adhesive applied to the underside of tab 54 as shown in FIG. 3. Likewise, tab 58 is folded back against end panel 56, glue applied to the surface of tab 58 as thus exposed, and upon gluing tab 28 to the next successive side wall panel 22 and collapsing the container with all the end panels 52, 44, 56, 42 folded inwardly, the end panels become affixed such that upon erecting the container the tabs pull one another into a closed condition in the plane of the bottom. FIG. 4 illustrates the nearly collapsed condition of the container. As shown, all the flaps are folded inwardly and glue tabs 54, 58, which are attached along perforations to end panels 52, 56, are glued to respective flap panels 42, 44 such that panels 42, 44 are unfolded when one forces the container from the position shown in FIG. 4 to that of FIG. 5. During this process, the fold tab 62 which attaches the larger of the flat panels 44 to the adjacent end panel 56 becomes folded backward against the surface of end panel 56 disposed within the container. At the same time, web 60 becomes folded, and the bottom of the container takes the appearance as shown in FIG. 6, similar to conventional self-erecting panels wherein folded back glue tabs 54, 58 are arranged to pull flap panels 44, 42 into their erected positions.

When the container is in the process of collapse or erection, the longer of the flap panels 44 may bind against the adjacent side wall panel 22. Accordingly, perforations 46 can be provided along the edge of panel 44, facilitating passage of flap panel 44 along the inside of sidewall panel 22 as the perforations allow the corner of panel 44 to be bent clear. Alternatively, panel 44 can be reduced in size, however, it is desirable that panel 44 substantially cover the bottom of the container and thereby provide a smooth sliding surface for tray member 122.

FIG. 7 illustrates the bending of the container edge along perforations 46. FIG. 7 also shows the relative positions of the two flap panels, the shorter flap panel 42 being the outermost panel, which is lower than longer flap panel 44 when the container is erected. FIG. 7 also shows the removable section 32 before it has been separated from side wall panel 24 along the intervening perforations.

Permanent web 60, which by means of back fold panel 62 permits flap panel 44 to remain permanently attached to end panel 56 (flap panel 44 already being attached to end panel 52 by glue tab 54), in the preferred embodiment is about half the length of end panel 56. This tab could be longer or shorter, however, longer tabs make erection somewhat more difficult and a shorter tab is more likely to break.

FIGS. 8 and 9 show details of the preferred tray member 120. Tray member 120 is also preferably formed from an integral blank as shown in FIG. 8. The side walls 122 of tray member 120 are folded upwardly, placing abutments 124 in position to engage the inner surfaces of side wall panel 24. The front extensions of the side walls are folded inwardly to engage slots at the front of the bottom section of tray member 120. Then the front most portion of the tray is folded over the front extensions and locking tabs at the free edge of the front most portion are tucked into the slots to hold the tray in the upright configuration shown in FIG. 9. Rear panel 142 can be bent upwardly on perforation 144, and the tray is ready for use.

The tray is dropped into the bottom of erected container 20, to reside in the position shown in FIG. 2. The container is then loaded with articles to be dispensed, for example small discrete articles. The rear panel 142 need not extend a great distance up the rear wall of container 20, it being sufficient that wall 142 defines an at least partly inclined plane down which the articles will slide toward the front of tray member 120, when the tray is pulled forwardly as shown in FIG. 1. The downward weight of the articles on panel 142 of tray 120 is sufficient to cause the tray to incline and rest against the rear side wall. This weight is also sufficient to bend perforation 146 at the free end of the tray, more securely guiding the articles toward the tray.

The device of the invention is useful for containers with removable panels generally, and is not limited to use with an internal tray member. For containers holding an internal stack of boxes or the like, removable panel 32 can be dimensioned to the size of the box, the lower most box being pulled out and the others dropping downwardly for access next. The container can be conveniently loaded from the top and unloaded from the bottom, while enjoying the convenience of a self-erecting bottom structure.

The invention as disclosed herein is a self-erecting container 20, comprising a plurality of side wall panels 22, 24 foldably attached to one another along corners of the container 20, one of the side wall panels 24 being a front side wall panel having a removable section 32 at an end of the container. A plurality of end panels 42, 44, 52, 56 are foldably attached to respective ones of the side wall panels 22, 24 at said end of the container, the end panels 42, 44, 52, 56 folding up when the container is erected and holding the side wall panels 22, 24 apart to define an inner volume of the container. One of the end panels 44 is a flat panel attached to the removable section 32 of the front side wall panel 24. An adjacent end panel 56 has a bellows fold panel with a back-folded tab 62 fixed to the flat panel 44 such that the flat panel and the bellows fold panel rest over one another when the container is erected, and the end panels 52, 44 and 56, 42 draw one another open when the side wall panels 22, 24 are folded apart. A permanently attached web 60 is disposed between the bellows fold panel 62 and the flap panel 44 adjacent the removable section 32, whereby the flap panel 44 remains fixed to the container 20 when the removable section 32 is separated from the front side wall panel 24.

Accordingly, the invention is an improved self-erecting container of the foregoing kind, wherein a removable panel resides directly adjacent a self-erecting end structure. The front side wall panel 24 has a removable section 32 at an end of the container adjacent the end panels 42, 56, 44, 52, the removable section 32 being separable from the front side wall panel 24. One of the flap panels 44 is attached at least initially to the removable section 32, an adjacent one of the end panels 56 being a bellows fold panel having a back-folded tab 62 fixed to the flap panel 44 such that the flat panel and the bellows fold panel rest over one another when the container is erected, and the end panels draw on another open when the side wall panels 22, 24 are folded apart. A permanently attached web 60 is disposed between the bellows fold panel 62 and the flap panel 44 adjacent the removable section 32, whereby the flap panel 44 remains fixed to the container when the removable section 32 is separated from the front side wall panel 24.

Preferably, the side wall panels 22, 24 and the end panels 42, 56, 44, 52 are integrally attached parts of a sheet. The flap panel 44 preferably defines an inner floor of the container when erected. The container preferably has four said side wall panels 22, 24 and four said end flaps 52, 44, 56, 42. A first pair of opposite end flaps are fold panels 52, 56 and a second pair of opposite end flaps are flap panels 42, 44.

The self-erecting container can further have a movable body 120 disposed within the container 20 behind the removable section 32, the movable body 120 being dimensioned to at least partly protrude through said front side wall panel 24 when the removable section 32 is separated. The removable section 32 can be permanently attached to the flap panel 44 and separable from the front side wall panel 24 and from adjacent side wall panels 22 along a perforation. The movable body is preferably an inwardly-open tray member 120.

The tray member 120 preferably has a rear flap 142 with a free edge slidable along an inner surface of a side wall panel 22 opposite to said front side wall panel 24, the rear flap 142 confining material within the container 20 to the tray member 120 when the tray member 120 protrudes through the front side wall panel 24. The rear flap 142 can be attached to a bottom of the tray member along a fold 144, and the rear flap 142 is approximately equal in dimensions to the flap panel 44. The tray member preferably has side walls 122 defining abutments 124 for stopping complete removal of the tray member 122 from the container.

The invention having been disclosed, a number of variations will now become apparent to persons skilled in the art. Reference should be made to the appended claims rather than the foregoing specification as indicating the true scope of the invention.

I claim:

1. A self-erecting container, comprising:

a plurality of sidewall panels foldably attached to one another along corners of the container, one of the sidewall panels being a front sidewall panel having a removable section at an end of the container;

a plurality of end panels foldably attached to respective ones of the sidewall panels at said end of the container, the end panels folding up when the container is erected and holding the sidewall panels apart to define an inner volume of the container, one of the end panels being a flap panel attached to said removable section of said front sidewall panel, and an adjacent one of the end panels being a bellows fold panel, the bellows fold panel having a back-folded tab fixed to the flap panel such that the flap panel and the bellows fold panel rest over one another when the container is erected, the end panels drawing one another open when the sidewall panels are folded apart; and, a permanently attached web disposed between the bellows fold panel and the flap panel adjacent the removable section, whereby the flap panel remains fixed to the container when the removable section is separated from said front sidewall panel.

2. The self-erecting container of claim 1, wherein the sidewall panels and the end panels are integrally attached parts of a sheet.

3. The self-erecting container of claim 1, wherein the flap panel defines an inner floor of the container when erected.

4. The self-erecting container of claim 1, comprising four said sidewall panels and four said end flaps, a first pair of opposite end flaps being fold panels and a second pair of opposite end flaps being flap panels.

5. The self-erecting container of claim 1, further comprising a movable body disposed within the container behind the removable section, the movable body being dimensioned to at least partly protrude through said front sidewall panel when the removable section is separated.

6. The self-erecting container of claim 5, wherein the removable section is permanently attached to the flap panel and is separable from the front sidewall panel and from adjacent sidewall panels along a perforation.

7. The self-erecting container of claim 5, wherein the movable body is an inwardly open tray member.

8. The self-erecting container of claim 7, wherein the tray member has a rear flap with a free edge slidable along an inner surface of a sidewall panel opposite to said front sidewall panel, the rear flap confining material within the container to the tray member when the tray member protrudes through the front sidewall panel.

9. The self-erecting container of claim 8, wherein the rear flap of the tray member is foldably attached to a bottom of the tray member and the rear flap is approximately equal in dimensions to said flap panel.

10. The self-erecting container of claim 9, wherein the tray member further comprises sidewalls defining abutments for stopping complete removal of the tray member from the container.

11. An improved self-erecting container of the kind having a plurality of sidewall panels foldably attached to one another along corners of the container, one of the sidewall panels being a front sidewall panel, a plurality of end panels foldably attached to respective ones of the sidewall panels at said end of the container, the end panels folding inwardly when the container is erected and holding the sidewall panels apart to define an inner volume of the container, the end panels including a pair of flap panels attached to a first pair of opposite sidewall panels and a pair of bellows fold panels attached to a second pair of opposite sidewall panels, the improvement comprising:

the front sidewall panel having a removable section at an end of the container adjacent the end panels, the removable section being separable from the front sidewall panel;

one of the flap panels being attached at least initially to the removable section, an adjacent one of the end panels being a bellows fold panel having a back-folded tab fixed to the flap panel such that the flap panel and the bellows fold panel rest over one another when the container is erected, and the end panels draw one another open when the sidewall panels are folded apart; and, a permanently attached web disposed between the bellows fold panel and the flap panel adjacent the removable section, whereby the flap panel remains fixed to the container when the removable section is separated from said front sidewall panel.

12. The self-erecting container of claim 11, wherein the sidewall panels and the end panels are integrally attached parts of a sheet.

13. The self-erecting container of claim 11, wherein the flap panel defines an inner floor of the container when erected.

14. The self-erecting container of claim 13, wherein the flap panel has at least one perforation spaced from an edge bearing against an inside surface of a sidewall panel adjacent the front sidewall panel, whereby the flap panel bends at the perforation during erection of the container.

15. The self-erecting container of claim 11, further comprising a movable body disposed within the container behind the removable section, the movable body being dimensioned to at least partly protrude through said front sidewall panel when the removable section is separated.

16. The self-erecting container of claim 15, wherein the removable section is permanently attached to the flap panel and is separable from the front sidewall panel and from adjacent sidewall panels along a perforation.

17. The self-erecting container of claim 15, wherein the movable body is an inwardly open tray member.

18. The self-erecting container of claim 17, wherein the tray member has a rear flap with a free edge slidable along an inner surface of a sidewall panel opposite to said front sidewall panel, the rear flap confining material within the container to the tray member when the tray member protrudes through the front sidewall panel.

19. The self-erecting container of claim 18, wherein the rear flap of the tray member is foldably attached to a bottom of the tray member and the rear flap is approximately equal in dimensions to said flap panel.

20. The self-erecting container of claim 19, wherein the tray member further comprises sidewalls defining abutments for stopping complete removal of the tray member from the container.

* * * * *